US010844607B2

(12) United States Patent
Potter

(10) Patent No.: US 10,844,607 B2
(45) Date of Patent: Nov. 24, 2020

(54) CLIP

(71) Applicant: Rocheway Pty Ltd, Brisbane (AU)

(72) Inventor: Graeme Potter, Brisbane (AU)

(73) Assignee: Rocheway Pty Ltd, Brisbane (AU)

( * ) Notice: Subject to any disclaimer, the term of this patent is extended or adjusted under 35 U.S.C. 154(b) by 0 days.

(21) Appl. No.: 16/273,596

(22) Filed: Feb. 12, 2019

(65) Prior Publication Data

US 2020/0123783 A1 Apr. 23, 2020

(30) Foreign Application Priority Data

Oct. 23, 2018 (AU) ..... 2018101589

(51) Int. Cl.
*E04F 13/08* (2006.01)

(52) U.S. Cl.
CPC ..... *E04F 13/0805* (2013.01)

(58) Field of Classification Search
CPC ..... E04F 13/0805; E04F 13/081; E04B 2001/8272; E04B 2001/8263; E04B 2009/186; E04B 9/183; F16F 1/376; F16F 1/36; F16F 1/371; F16F 1/3713; F16F 1/3732; F16F 1/3737; F16B 2/20; F16B 2/205; F16B 2/22; F16B 2/243; F16B 2/245; F16B 2/246
See application file for complete search history.

(56) References Cited

U.S. PATENT DOCUMENTS 1,350,349 A * 8/1920 Walther ..... E04F 15/20 52/402
RE19,431 E * 1/1935 Balduf ..... E04B 1/84 52/346
2,115,238 A * 4/1938 Stevens ..... E04B 1/84 52/402

(Continued)

FOREIGN PATENT DOCUMENTS

DE 1434163 A1 * 4/1969 ..... E04F 13/0805
DE 10052730 A1 * 5/2002 ..... E04B 9/20

(Continued)

OTHER PUBLICATIONS

Machine translation for foreign reference EP1201841, obtained from https://patentscope.wipo.int/search/en/detail.jsf?docId=EP13711184&tab=PCTDESCRIPTION&_cid=P12-K3QC4P-64862-1#atapta0 (last accessed on Dec. 3, 2019) (Year: 2019).*

(Continued)

*Primary Examiner* — Theodore V Adamos
(74) *Attorney, Agent, or Firm* — Wegman Hessler

(57) ABSTRACT

A clip for mounting a furring channel to a support structure, the clip having a body portion attachable relative to the support structure, at least one connection portion extending transversely from the body portion, each of the at least one connection portion has two opposed connection positions adapted to connect to the furring channel, at least one leg portion extending transversely from the body portion away from the at least one connection portion, and a foot portion (Continued)

extending transversely from each of the at least one leg portion, wherein in use, when the body portion is attached relative to the support structure, each foot portion is proximal to the support structure and each of the at least one connection portion is distal to the support structure.

14 Claims, 15 Drawing Sheets

(56) References Cited

U.S. PATENT DOCUMENTS

| | | | | |
|---|---|---|---|---|
| 4,110,948 | A * | 9/1978 | Maier, Jr. | E04D 3/3608 52/402 |
| 5,788,206 | A * | 8/1998 | Bunker | B60K 17/00 248/634 |
| 6,267,347 | B1 * | 7/2001 | Ryan | F16F 1/3732 248/562 |
| 7,093,814 | B2 * | 8/2006 | Meisel | F16F 1/44 248/562 |
| 7,303,050 | B2 * | 12/2007 | Rogger | B66B 7/024 104/124 |
| 9,200,439 | B1 * | 12/2015 | Egri, II | E04F 13/0805 |
| D810,545 | S * | 2/2018 | Stevens | E04B 1/84 D8/349 |
| 10,174,501 | B1 * | 1/2019 | Underkofler | E04B 9/16 |
| 2007/0294972 | A1 * | 12/2007 | Ducharme | G10K 11/16 52/351 |
| 2008/0017780 | A1 * | 1/2008 | Downey | E04B 1/82 248/610 |
| 2008/0086966 | A1 * | 4/2008 | Stevens | E04B 1/84 52/347 |
| 2008/0201743 | A1 * | 8/2008 | Stevens | G09B 21/009 725/46 |
| 2008/0202846 | A1 * | 8/2008 | Gernhart | F16F 15/04 181/208 |
| 2009/0242726 | A1 * | 10/2009 | Carels | E04B 1/82 248/562 |
| 2009/0283359 | A1 * | 11/2009 | Ravnaas | E04B 1/82 181/286 |
| 2014/0318077 | A1 * | 10/2014 | Case | E04B 1/82 52/843 |
| 2017/0044767 | A1 * | 2/2017 | Gloftis | E04B 9/183 |
| 2017/0044773 | A1 * | 2/2017 | Gernhart | E04F 13/0807 |
| 2018/0238052 | A1 * | 8/2018 | Downey | E04B 9/001 |

FOREIGN PATENT DOCUMENTS

| | | | | |
|---|---|---|---|---|
| EP | 1201841 | A1 * | 5/2002 | E04B 9/20 |
| FR | 2508079 | A1 * | 12/1982 | E04B 9/183 |

OTHER PUBLICATIONS

Machine translation of foreign reference DE1434163, obtained from https://translationportal.epo.org/emtp/translate/?ACTION=description-retrieval&COUNTRY=DE&ENGINE=google&FORMAT=docdb&KIND=A1&LOCALE=en_EP&NUMBER=1434163&SRCLANG=de&TRGLANG=en (last accessed on Aug. 3, 2020) (Year: 2020).*

Machine translation of foreign reference DE 10052730 A1, obtained from https://translationportal.epo.org/emtp/translate/?ACTION=description-retrieval&COUNTRY=DE&ENGINE=google&FORMAT=docdb&KIND=A1&LOCALE=en_EP&NUMBER=10052730&SRCLANG=de&TRGLANG=en (last accessed on Aug. 3, 2020) (Year: 2020).*

Machine translation of foreign reference FR2508079, obtained from https://translationportal.epo.org/emtp/translate/?ACTION=description-retrieval&COUNTRY=FR&ENGINE=google&FORMAT=docdb&KIND=A1&LOCALE=en_EP&NUMBER=2508079&SRCLANG=fr&TRGLANG=en (last accessed on Aug. 3, 2020) (Year: 2020).*

* cited by examiner

CLIP

CROSS-REFERENCE TO RELATED APPLICATIONS

This application claims the priority filing benefit of Australian Patent Application No. 2018101589 filed Oct. 23, 2018, which is incorporated herein by reference in its entirety.

FIELD OF INVENTION

The present invention relates to a clip. The present invention has particular but not exclusive application for mounting a furring channel onto a support structure such as existing building wall or ceiling structures to provide a furring support framework for wall or ceiling cladding. The patent specification describes this use but it is by way of example only and the invention is not limited to this use.

BACKGROUND OF THE INVENTION

Walls and ceilings of buildings are sometimes clad with wall or ceiling cladding to provide an aesthetical appearance, or to cover utilities such as power cables, water pipes, HVAC ducts or the like.

The wall or ceiling cladding is typically secured to the existing wall or ceiling by a support framework of furring channels. The wall or ceiling cladding is typically secured to the furring channels using fasteners such as screws. The furring channels are attached to the wall or ceiling by clips (also referred to as furring channel clips) which are attached on to the wall or ceiling in a spaced apart manner. The furring channels are secured to the clips by positioning them over and snapping them into the clips.

One problem that can arise from such a configuration is a lack of space to accommodate utilities. A prior art solution to this problem is to provide a furring channel of greater thickness.

Another problem that can arise by securing the clips to the wall or ceiling and the wall or ceiling cladding to the furring channels is that vibrations and noise can travel from the wall or ceiling to the wall or ceiling cladding.

One prior art solution to mitigating the transmission of vibration or sound is to provide an underlay between the clip and the wall or ceiling and/or between the wall or ceiling cladding and the furring channel.

OBJECT OF THE INVENTION

It is an object of the present invention to overcome or at least alleviate one or more of the abovementioned problems with furring channel support frameworks and/or provide the consumer with a useful or commercial choice.

SUMMARY OF THE INVENTION

In one aspect, the present invention broadly resides in a clip for mounting a furring channel to a support structure, the clip having a body portion attachable relative to the support structure;

at least one connection portion extending transversely from the body portion, each of the at least one connection portion has two opposed connection positions adapted to connect to the furring channel;

at least one leg portion extending transversely from the body portion away from the at least one connection portion; and a foot portion extending transversely from each of the at least one leg portion, wherein in use, when the body portion is attached relative to the support structure, each foot portion is proximal to the support structure and each of the at least one connection portion is distal to the support structure.

Preferably, the body portion is substantially planar. Preferably the body portion is substantially rectangular in shape, Preferably the body portion has two opposed sides and two opposed ends.

Preferably the body portion preferably includes an aperture. The aperture is preferably adapted to receive a fastener such as a bolt or a screw, Preferably the aperture is adapted to receive a grommet. More preferably the aperture is adapted to receive a grommet and a ferrule. Preferably the grommet and/or ferrule prevent direct contact between the body portion of the clip and the fastener.

Preferably each of the at least one connection portion extends at substantially 90° from the body portion. Preferably each of the at least one connection portion extends from a respective one of the two opposed sides of the body portion.

Preferably the at least one connection portion is two connection portions. Preferably the two connection portions are opposed to one another. Preferably the two opposed connection portions extend from the two opposed sides of the body portion. Preferably each of the at least one connection portion is substantially planar.

Preferably each of the two opposed connection positions are defined by two opposed notches. Preferably the opposed notches are adapted to retain therein lips of a furring channel. Preferably each of the two opposed connection positions is located between 2 mm to 45 mm away from the body portion of the clip. More preferably, each of the two opposed connection positions is located between 5 mm to 30 mm away from the body portion of the clip. In one embodiment, each of the two opposed connection positions is located substantially 10 mm away from the body portion of the clip. In another embodiment, each of the two opposed connection positions is located substantially 15 mm away from the body portion of the clip. In a further embodiment, each of the two opposed connection positions is located substantially 20 mm away from the body portion of the clip. In yet another embodiment, each of the two opposed connection positions is located substantially 25 mm away from the body portion of the clip.

Preferably each of the at least one leg portion extends at substantially 90° from the body portion. Preferably each of the at least one leg portion extends from the body portion in a direction substantially opposite to the direction each of the at least one connection portion extends from the body portion. Preferably each of the at least one leg portion extends from a respective one of the two opposed ends of the body portion. Preferably the at least one leg portion is two leg portions. Preferably the two leg portions are opposed to one another. Preferably the two opposed leg portions extend from the two opposed ends of the body portion. Preferably each of the at least one leg portion are substantially rectangular in shape, Preferably each of the at least one leg portion is substantially planar.

Preferably each leg portion has a length between the body portion and a corresponding foot portion of between 5 mm to 35 mm. More preferably each leg portion has a length between the body portion and a corresponding foot portion of between 10 mm to 25 mm. In one embodiment, each leg portion has a length between the body portion and a corresponding foot portion of substantially 10 mm. In another embodiment, each leg portion has a length between the body portion and a corresponding foot portion of substantially 15 mm. In a further embodiment, each leg portion has a length between the body portion and a corresponding foot portion of substantially 25 mm.

Preferably each foot portion extends at substantially 90° from the corresponding one of the at least one leg portion. Preferably each foot portion extends in a direction substantially parallel to the body portion. Preferably there are two leg portions and there are two foot portions, each of the foot portions extending from a corresponding one of the two leg portions. Preferably each of the two foot portions extend towards each other. Preferably each foot portion is substantially planar. Preferably each foot portion includes rounded edges. More preferably each foot portion includes two rounded edges.

Preferably the clip is made from metal. Preferably the metal is bent or pressed into the shape of the clip. Preferably the metal is steel. Preferably the thickness of the metal is in the range of 0.5 mm to 1.5 mm. More preferably the thickness of the metal is substantially 1 mm.

In another aspect, the present invention broadly resides in a clip assembly for mounting a furring channel to a support structure, the clip assembly having a clip having a body portion attachable relative to the support structure;

at least one connection portion extending transversely from the body portion, each of the at least one connection portion has two opposed connection positions adapted to connect to the furring channel;

at least one leg portion extending transversely from the body portion away from the at least one connection portion; and a foot portion extending transversely from each of the at least one leg portion; and an insulation member adapted to at least cover a portion of an outer surface of the body portion, a portion of an outer surface of each of the at least one leg portion and a portion of an outer surface of each foot portion;

wherein in use, when the body portion is attached relative to the support structure, each foot portion is proximal to the support structure and each of the at least one connection portion is distal to the support structure, and a portion of the insulation member is located between each foot portion and the support structure.

Preferably the clip of the clip assembly is a clip as described in this specification.

The insulation member preferably includes elastic material to inhibit or reduce vibrations from passing therethrough. The insulation member preferably includes resilient material to inhibit or reduce vibrations from passing therethrough. The insulation member preferably includes a rubber or plastic material to inhibit or reduce vibrations from passing therethrough. More preferably the insulation member includes a rubber material to inhibit or reduce vibrations from passing therethrough.

In one embodiment, the insulation member is made by extrusion. In another embodiment, the insulation member is made by moulding or casting.

The insulation member preferably has a bed portion adapted to at least cover a portion of the outer surface of the body portion. The outer surface of the body portion preferably faces in the same direction that the at least one connection portion extends from the body portion. The bed portion is preferably substantially rectangular in shape. Preferably the bed portion includes an aperture. Preferably, the aperture of the bed portion aligns with the aperture of the body portion of the clip in use. The bed portion is preferably substantially planar. The bed portion is preferably substantially rectangular in shape.

Preferably the insulation member includes a grommet extending from the bed portion. Preferably an aperture in the grommet defines the aperture in the bed portion. Preferably the grommet is adapted to be at least partially inserted into the aperture of the body portion. In another embodiment, the clip assembly includes a grommet adapted to be at least partially inserted into the aperture of the body portion.

The grommet preferably includes elastic material to inhibit or reduce vibrations from passing therethrough. The grommet preferably includes resilient material to inhibit or reduce vibrations from passing therethrough. The grommet preferably includes a rubber or plastic material to inhibit or reduce vibrations from passing therethrough. More preferably the grommet includes a rubber material to inhibit or reduce vibrations from passing therethrough.

The insulation member preferably has one or more flank portions adapted to at least cover a portion of the outer surface of the at least one leg portion. The one or more flank portions preferably extend from the bed portion. The one or more flank portions preferably extend at substantially 90° from the bed portion. If the clip has a single leg portion, the insulation member preferably has a single flank portion. If the clip has two leg portions, the insulation member preferably has two flank portions. Preferably the clip has two leg portions and the insulation member has two flank portions. The flank portions are preferably substantially planar. The flank portions are preferably substantially rectangular in shape.

The insulation member preferably has a support portion adapted to at least cover a portion of the outer surface of a corresponding foot portion of the clip. Each support portion preferably extends from a corresponding one of the flank portions. Each support portion preferably extends at substantially 90° from the corresponding flank portion. The insulation member preferably has two flank portions and a support portion extends from each of the two flank portions. Each support portion is preferably substantially planar. Each support portion is preferably substantially rectangular in shape.

Preferably in use, when the body portion of the clip is attached relative to the support structure, each support portion is located between a corresponding foot portion and the support structure.

In one embodiment, each support portion has a plurality of projections extending therefrom. Preferably in use, the plurality of projections extend in a direction away from the clip. Preferably the plurality of projections provide additional insulation between the clip and the support member. In one embodiment, the plurality of projections are ribs. Preferably the ribs are parallel to one another. In another embodiment, the plurality of projections are knobs, nibs or lugs.

Preferably each support portion has a skirt portion. Preferably each skirt portion is adapted to attach to an end of the corresponding foot portion of the clip to hold the insulation member in place on the clip. More preferably each skirt portion is adapted to straddle an end of the corresponding foot portion of the clip to hold the insulation member in place on the clip.

The clip assembly preferably includes a ferrule. The ferrule is preferably adapted to be inserted into the aperture of the body portion. The ferrule preferably includes a rim portion adapted to prevent the ferrule from passing all the way through the aperture in the body portion. The ferrule is preferably adapted to be inserted into the aperture of the grommet. The ferrule is preferably adapted to accept a fastener to fasten the clip assembly to a support structure. In use the ferrule preferably extends at least between the body portion and the support structure. Preferably the ferrule prevents the fastener from damaging the clip if the fastener is overtightened.

In a further aspect, the present invention broadly resides in an insulation member for a clip assembly, the insulation member having a substantially planar bed portion having two opposed ends;

two flank portions, each extending from an opposed end of the bed portion at substantially 90° to the bed portion; and a support portion extends at substantially 90° from each of the flank portion, each of the support portions including a plurality of projections extending therefrom in a direction away from the bed portion.

Preferably the insulation member is an insulation member as described in this specification.

In another aspect, the present invention broadly resides in a clip for mounting a furring channel to a support structure, the clip having a body portion attachable relative to the support structure;

two opposed connection portions, each of the connection portions extending transversely from a side the body portion, each of the two connection portion has two opposed connection positions adapted to connect to the furring channel;

two opposed leg portions, each of the leg portions extending transversely from an end of the body portion in a direction away from the two connection portions; and a foot portion extending transversely from each of the two leg portion portions, each foot portion substantially parallel to the body portion, wherein in use, when the body portion is attached relative to the support structure, each foot portion is proximal to the support structure and each of the two connection portions is distal to the support structure.

The features described with respect to one aspect also apply where applicable to all other aspects of the invention. Furthermore, different combinations of described features are herein described and claimed even when not expressly stated.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENT

Figure 1:
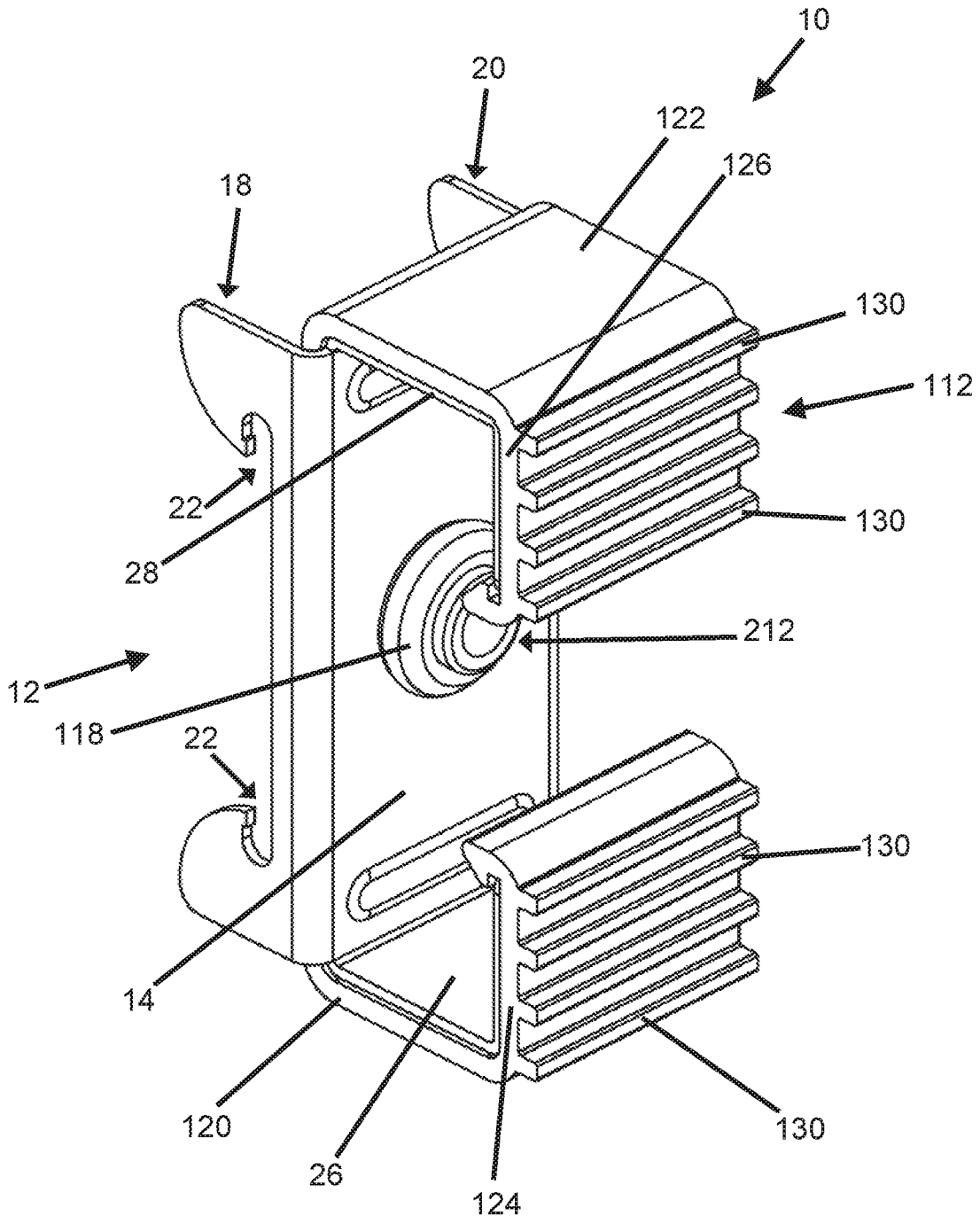
FIG. 1 is a perspective view of a clip assembly according to an embodiment of the present invention.
Figure 2:
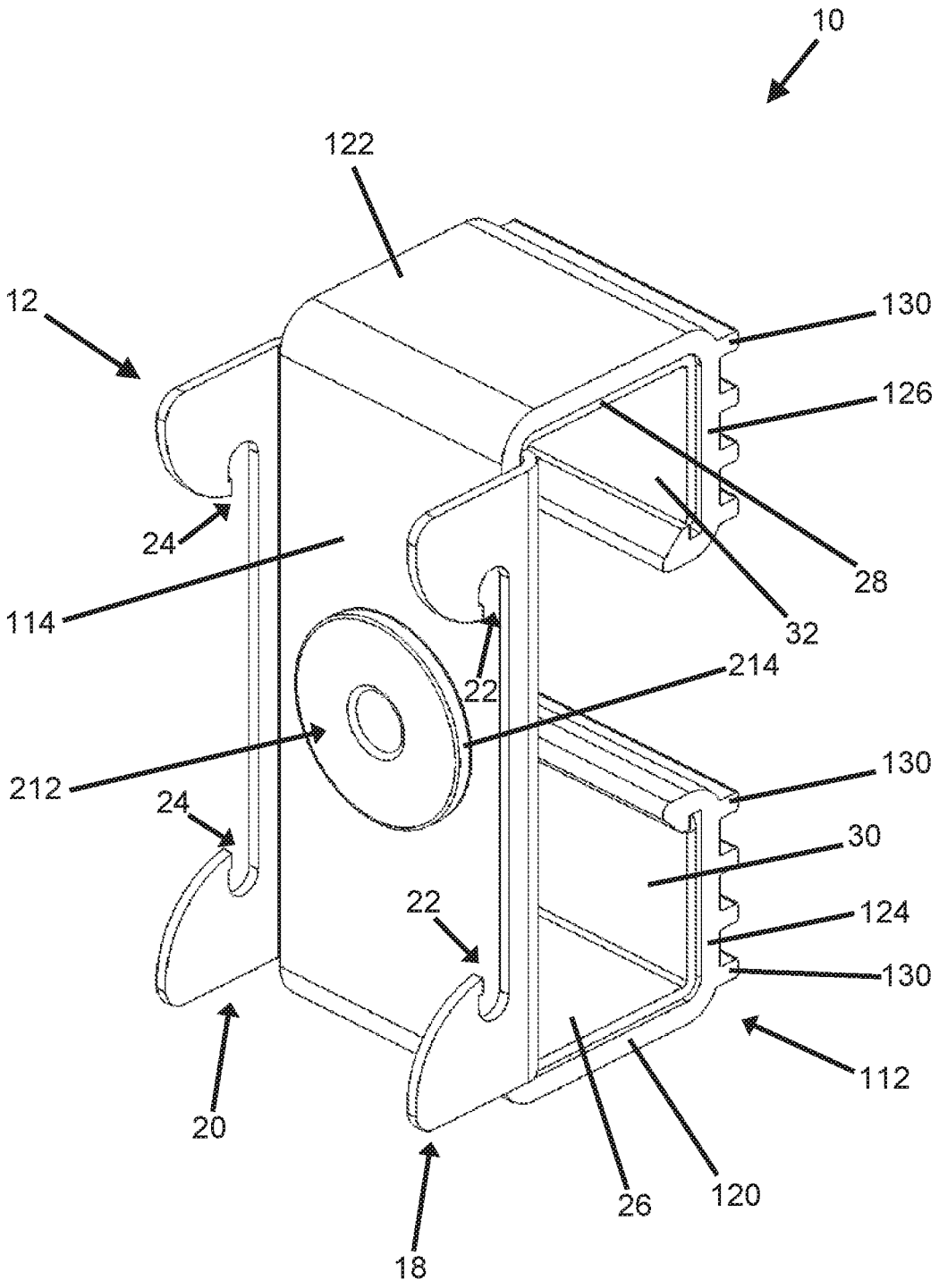
FIG. 2 is a top perspective view of the clip assembly of FIG. 1.
Figure 3:
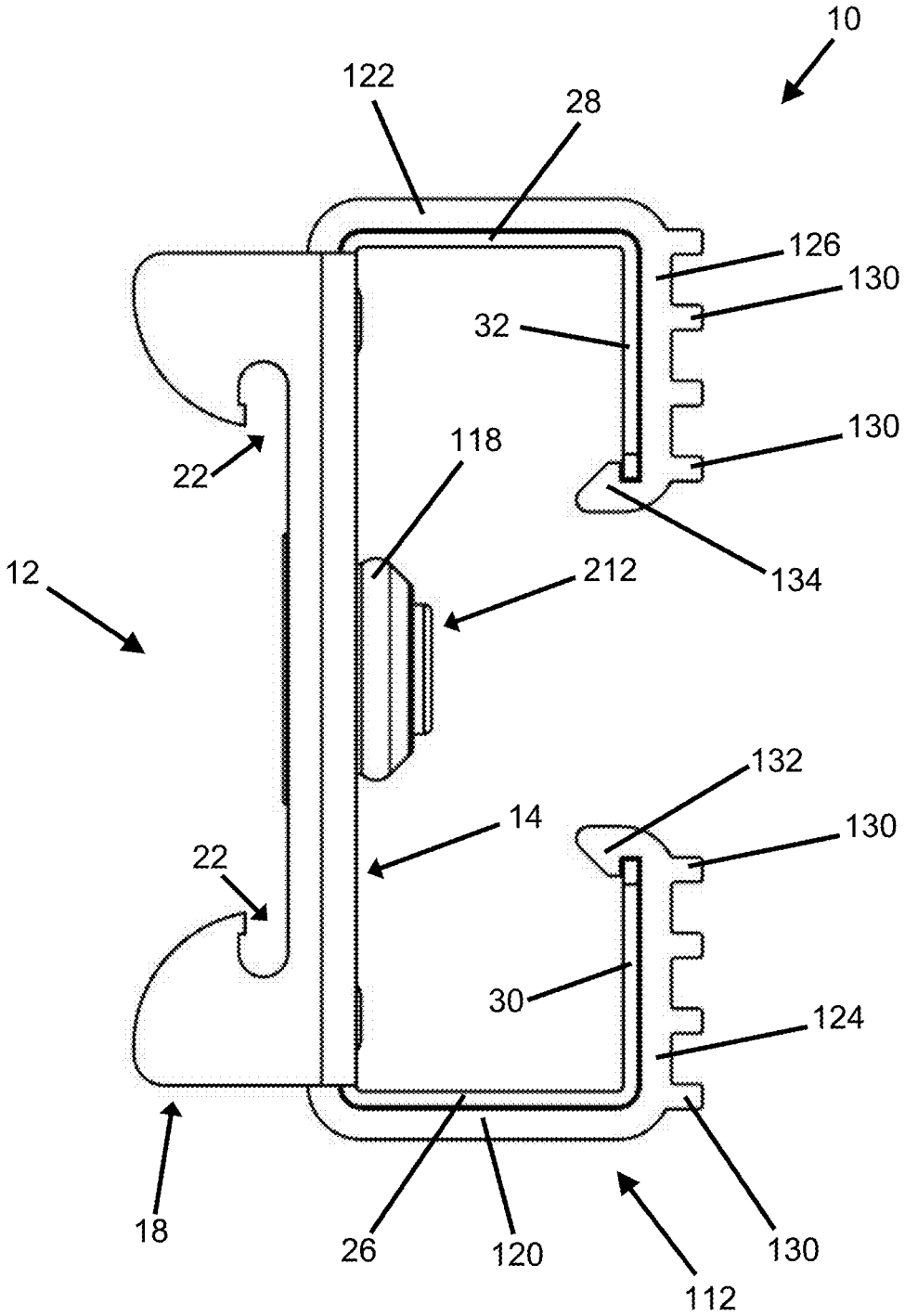
FIG. 3 is a side view of the clip assembly of FIG. 1.
Figure 4:
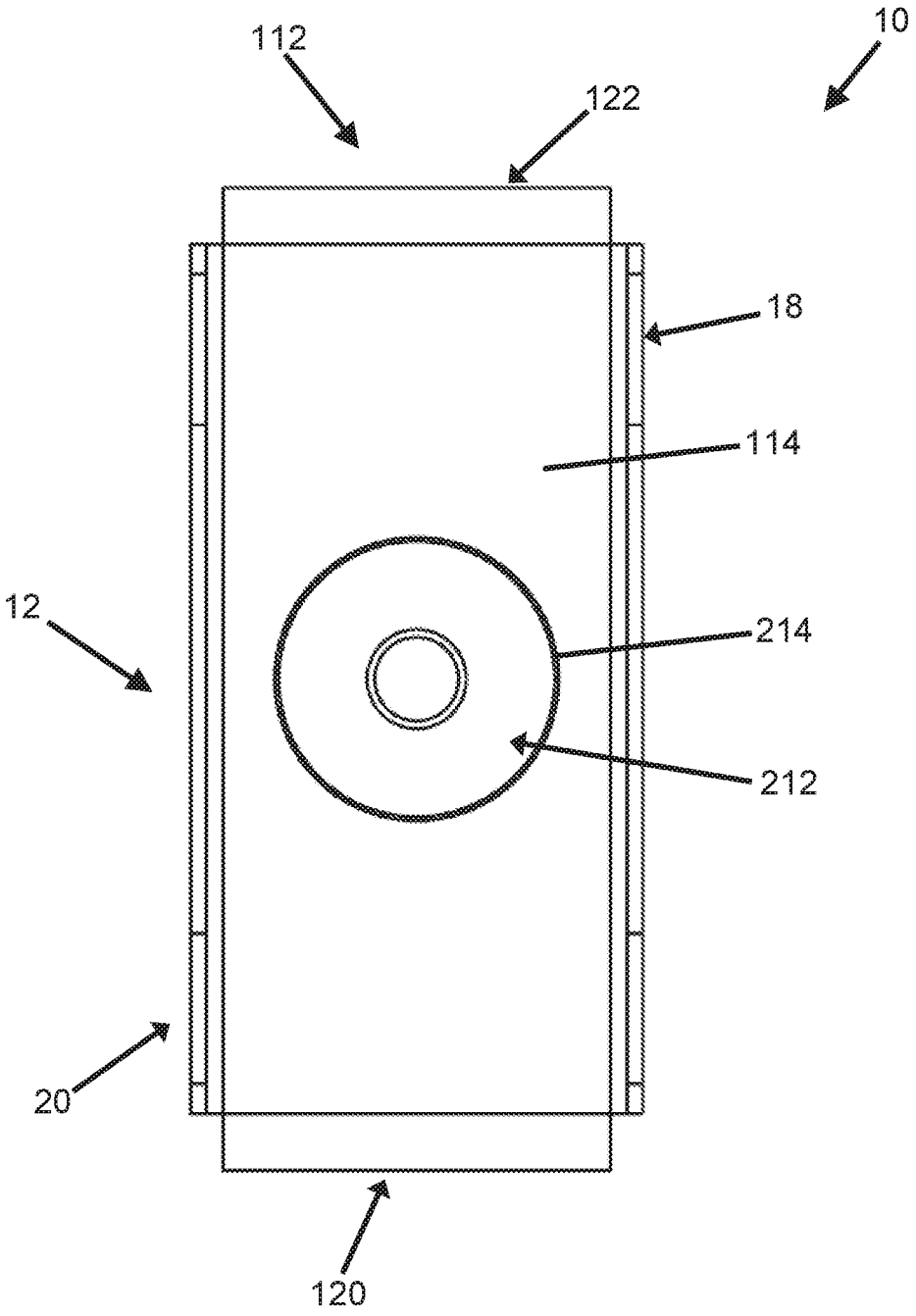
FIG. 4 is a top view of the clip assembly of FIG. 1.
Figure 5:
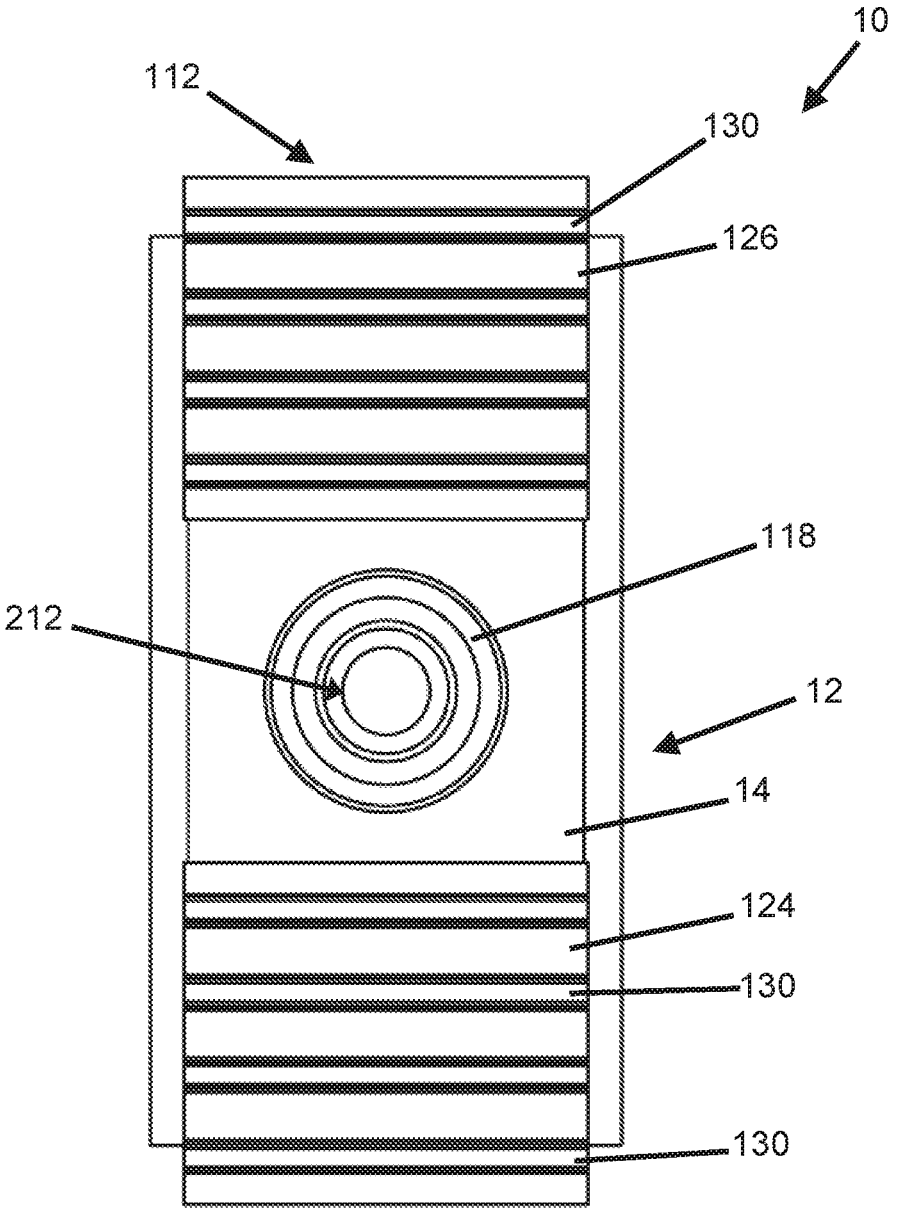
FIG. 5 is a bottom view of the clip assembly of FIG. 1.
Figure 6:
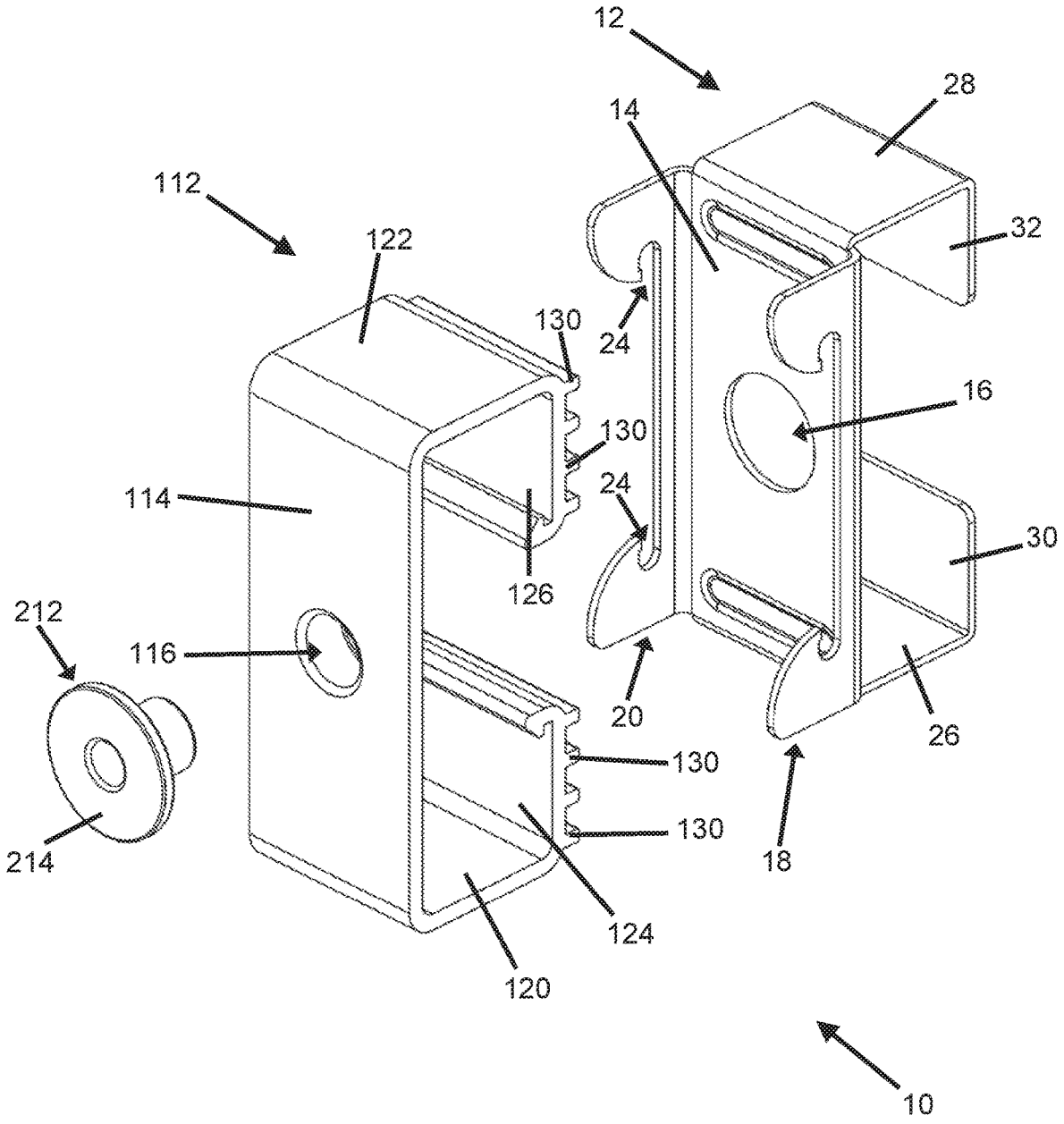
FIG. 6 is an exploded view of the clip assembly of FIG. 1.

With reference to FIGS. 1 to 6, there is shown a clip assembly 10 according to an embodiment of the present invention. The clip assembly 10 includes a clip 12. The clip assembly includes an insulation member 112 to partially cover the clip. The clip assembly 10 includes a ferrule 212.

The clip 12 has a body portion 14. The body portion 14 is planar and substantially rectangular. The body portion has an aperture 16 located therethrough. The aperture 16 is adapted to attach the clip assembly 10 to a support structure (not shown) via a fastener (not shown) as will be explained in more detail below.

Two opposed connection portions 18,20 extend at 90° from sides of the body portion 14. Each of the two connection portions 18,20 has two opposed connection positions in the form of recesses 22,24. The recesses 22,24 are adapted to connect to a furring channel (not shown).

Two opposed leg portions 26,28 extend at 90° from ends of the body portion 14.

A foot portion 30,32 extends at 90° from each of the two leg portions 26,28. The foot portions 30,32 are substantially parallel to the body portion 14.

The insulation member 112 is made from rubber to inhibit vibrations from passing therethrough.

The insulation member 112 has a bed portion 114. The bed portion 114 is adapted to at least cover a portion of the outer surface of the body portion 14 of the clip 12. The bed portion 114 includes an aperture 116.

Preferably the insulation member 112 includes a grommet 118 extending from the bed portion 114. The aperture 16 extends through the grommet 118. In use, the grommet 118 is adapted to be at least partially inserted into the aperture 16 of the body portion 14 of the clip 12.

The insulation member 112 has two flank portions 120, 122 adapted to at least cover a portion of the outer surface of the corresponding leg portions 26,28.

The insulation member 112 has support portions 124,126. The support portions 124,126 extend from the flank portions 120,122 and are adapted to at least cover a portion of the outer surface of a corresponding foot portion 30,32 of the clip 12.

Each support portion 124,126 has a plurality of projections in the form of ribs 130 extending therefrom.

Each support portion 124,126 has a corresponding skirt portion 132,134. Each skirt portion 132,134 is adapted to attach to an end of the corresponding foot portion of the clip to hold the insulation member in place on the clip.

In use, when the body portion 14 of the clip is attached relative to a support structure (not shown), each support portion 124,126 is located between a corresponding foot portion 30,32 and the support structure, inhibit vibration from traveling from the support structure through the clip 12 into the furring channel and into wall or ceiling cladding (not shown) attached to the furring channel.

The ferrule 212 is adapted to be inserted into the aperture 16. The ferrule 212 includes a rim portion 214 adapted to prevent the ferrule from passing all the way through apertures 16,116. The ferrule 212 is adapted to accept a fastener such as a screw to fasten the clip assembly 10 to a support structure (not shown). In one embodiment (not shown) the ferrule extends at least between the body portion and the support structure to prevent a fastener (not shown) from damaging the clip if the fastener is overtightened.

Figure 7:
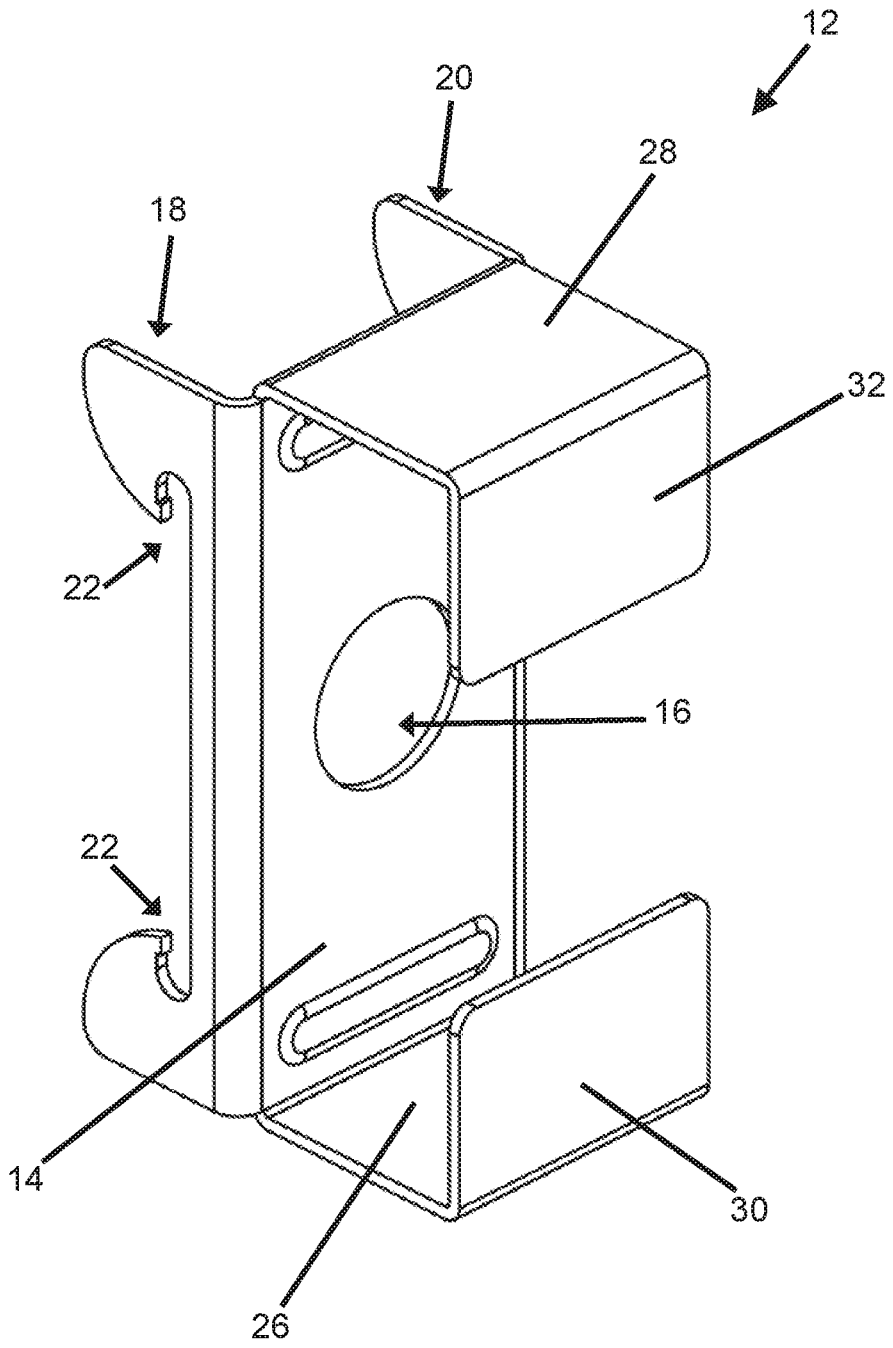
FIG. 7 is a perspective view of the clip of the clip assembly of FIG. 1.
Figure 8:
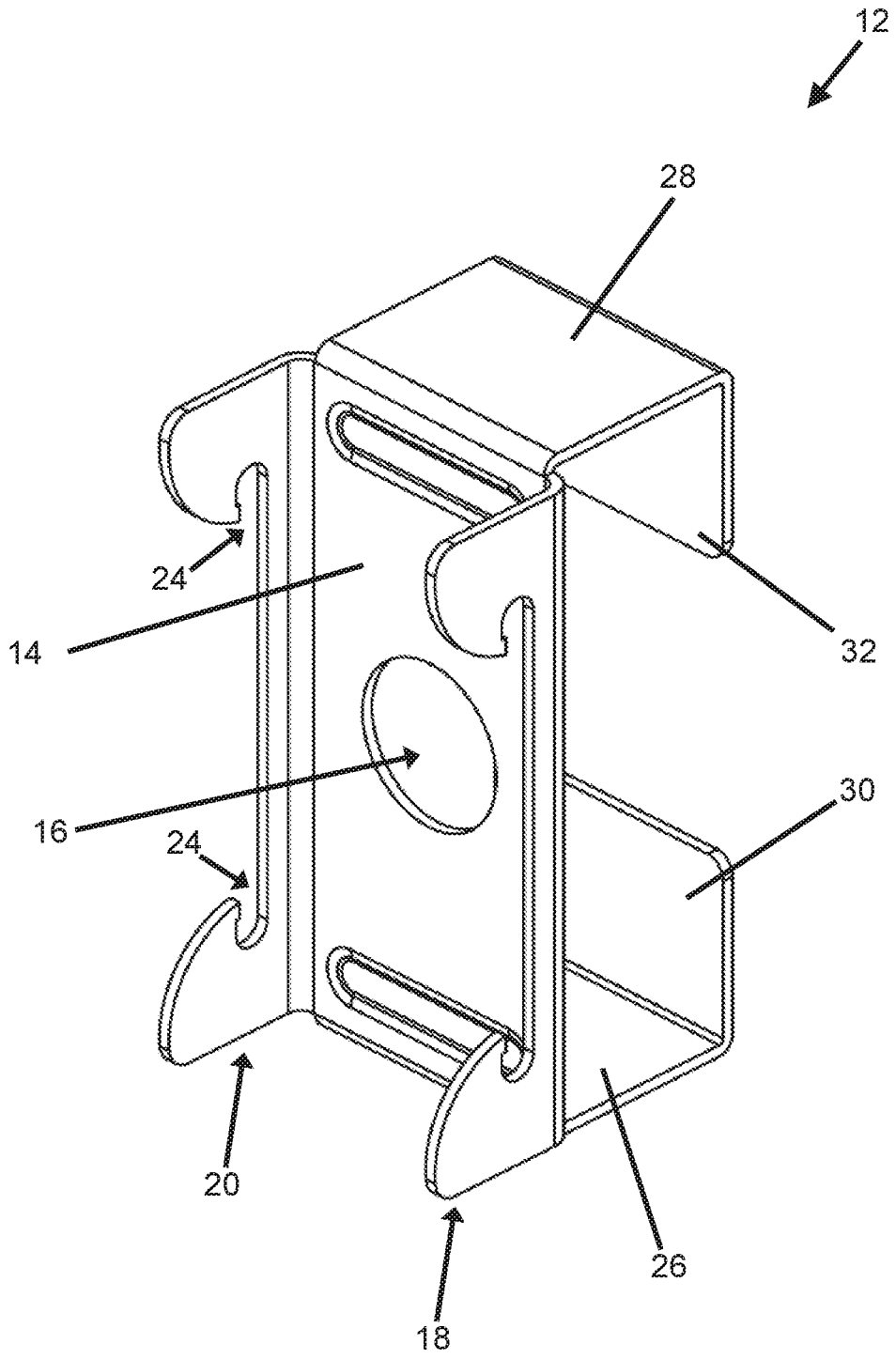
FIG. 8 is a top perspective view of the clip of the clip assembly of FIG. 1.
Figure 9:
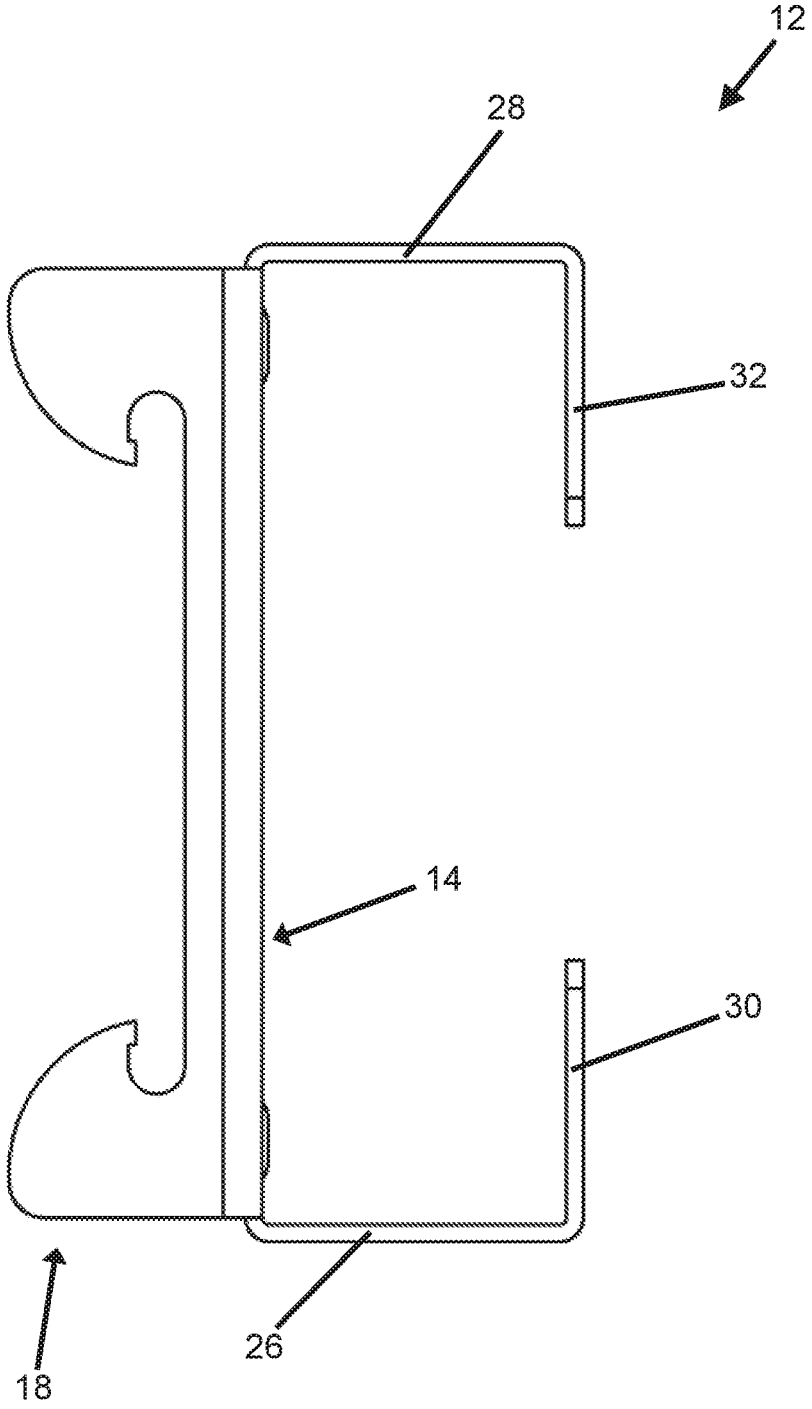
FIG. 9 is a side view of the clip of the clip assembly of FIG. 1.

With reference to FIGS. 7 to 9, there is shown the clip 12 of the clip assembly 10 of FIGS. 1 to 6 in more detail. The two opposed leg portions 26,28 have a length of 25 mm between the body portion 14 and the corresponding foot portion 30,32

Figure 10:
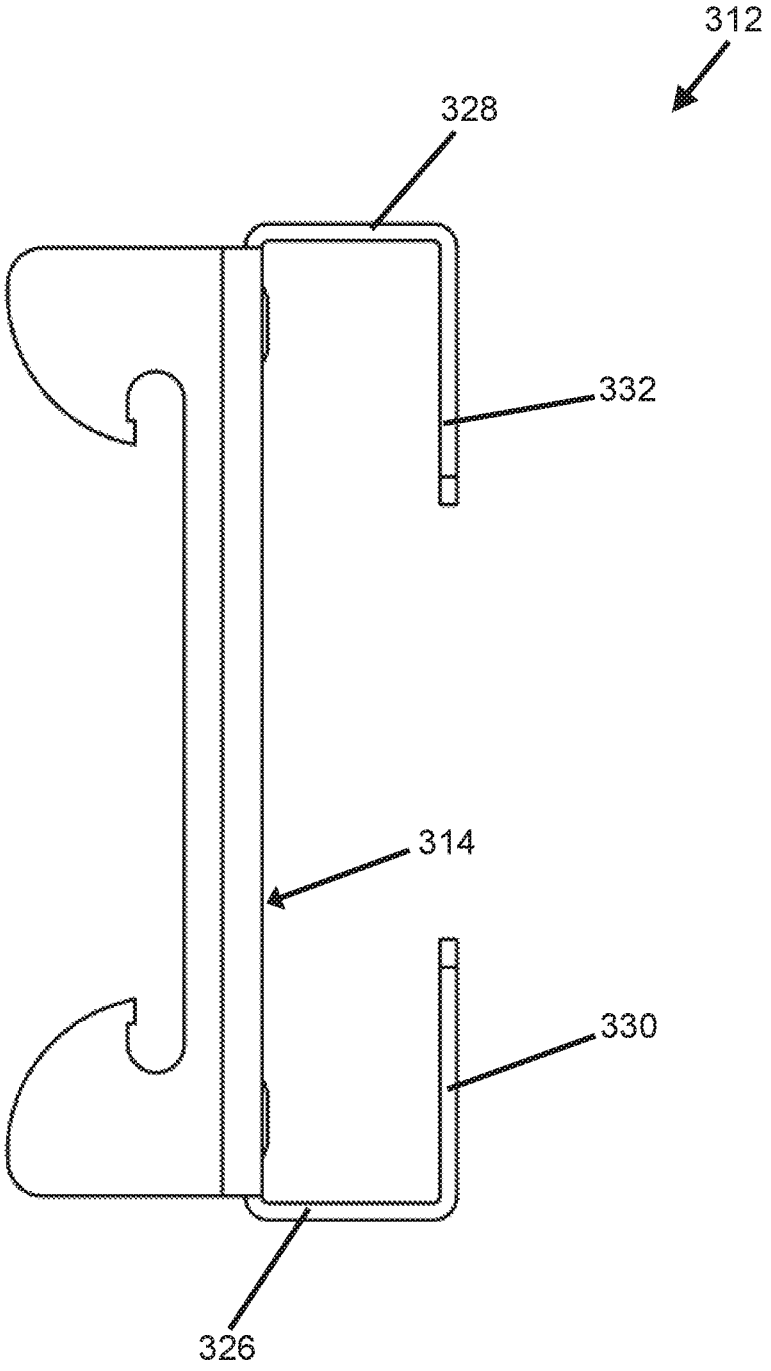
FIG. 10 is a side view of a clip according to another embodiment of the present invention.

With reference to FIG. 10, there is shown a clip 312 according to another embodiment of the invention. The two opposed leg portions 326,328 have a length of 15 mm between the body portion 314 and the corresponding foot portion 330,332.

Figure 11:
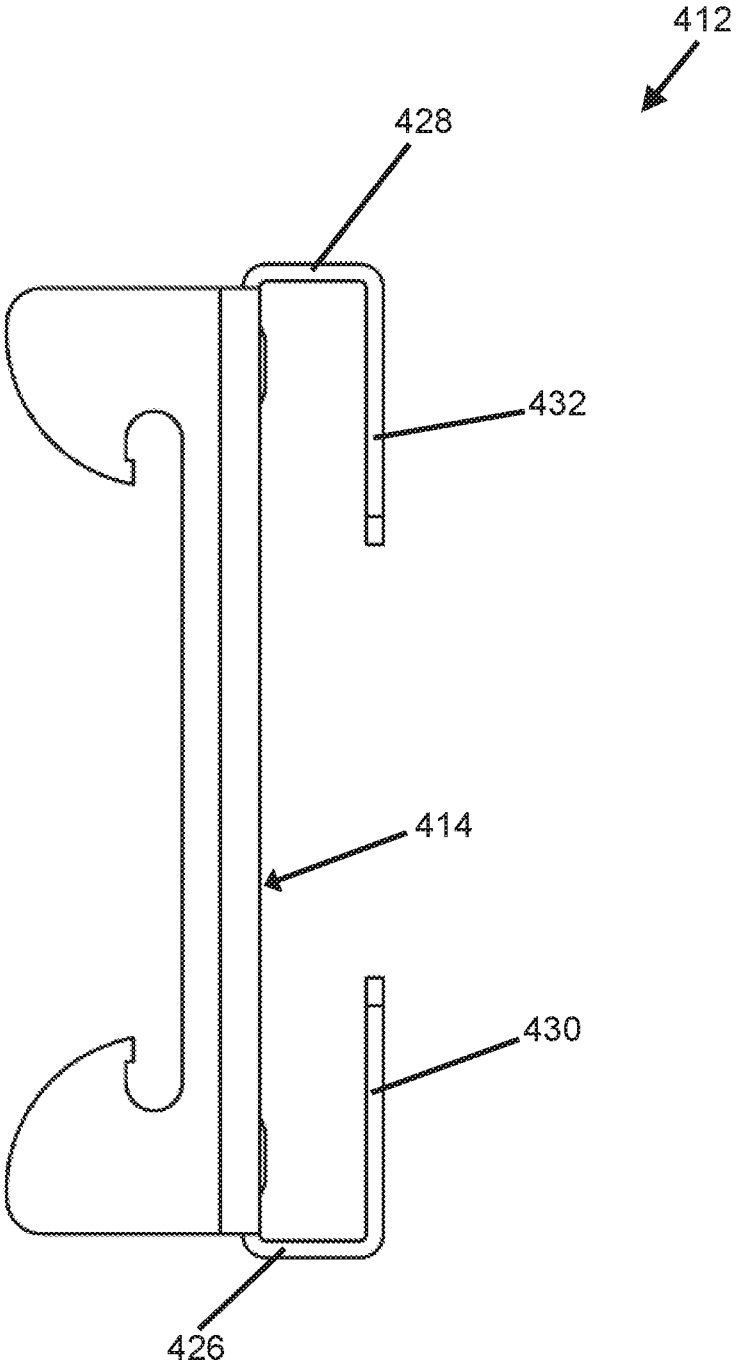
FIG. 11 is a side view of a clip according to a further embodiment of the present invention.

With reference to FIG. 11, there is shown a clip 412 according to a further embodiment of the invention. The two opposed leg portions 426,428 have a length of 10 mm between the body portion 414 and the corresponding foot portion 430,432.

Figure 12:
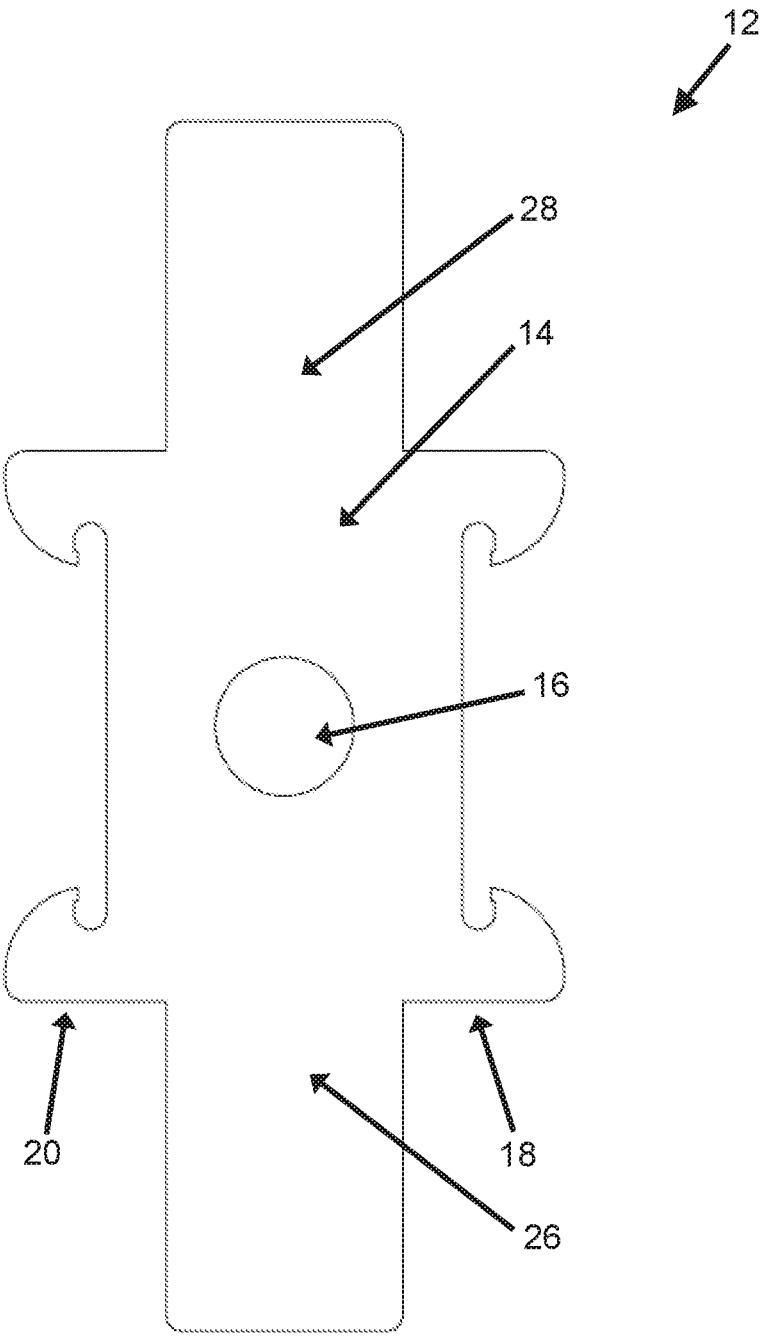
FIG. 12 is a top view of the clip of the clip assembly of FIG. 1 prior to being bent into shape.

With reference to FIG. 12, there is shown the clip 12 of FIGS. 7 to 9 prior to being bent into shape. The clip 12 is a single piece that is punched out of sheet metal before being bent into shape.

Figure 13:
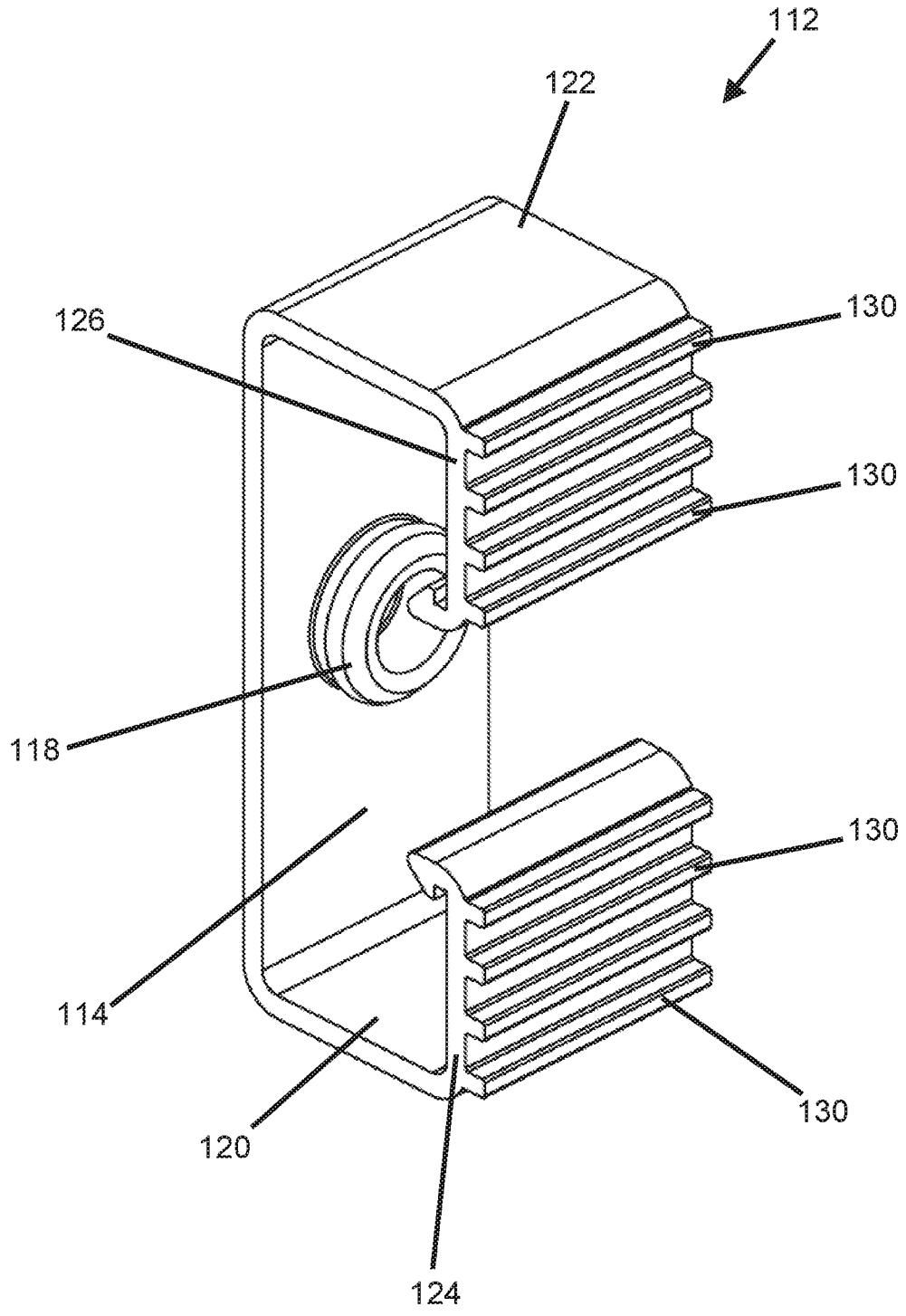
FIG. 13 is a perspective bottom view of the insulation of the clip assembly of FIG. 1.
Figure 14:
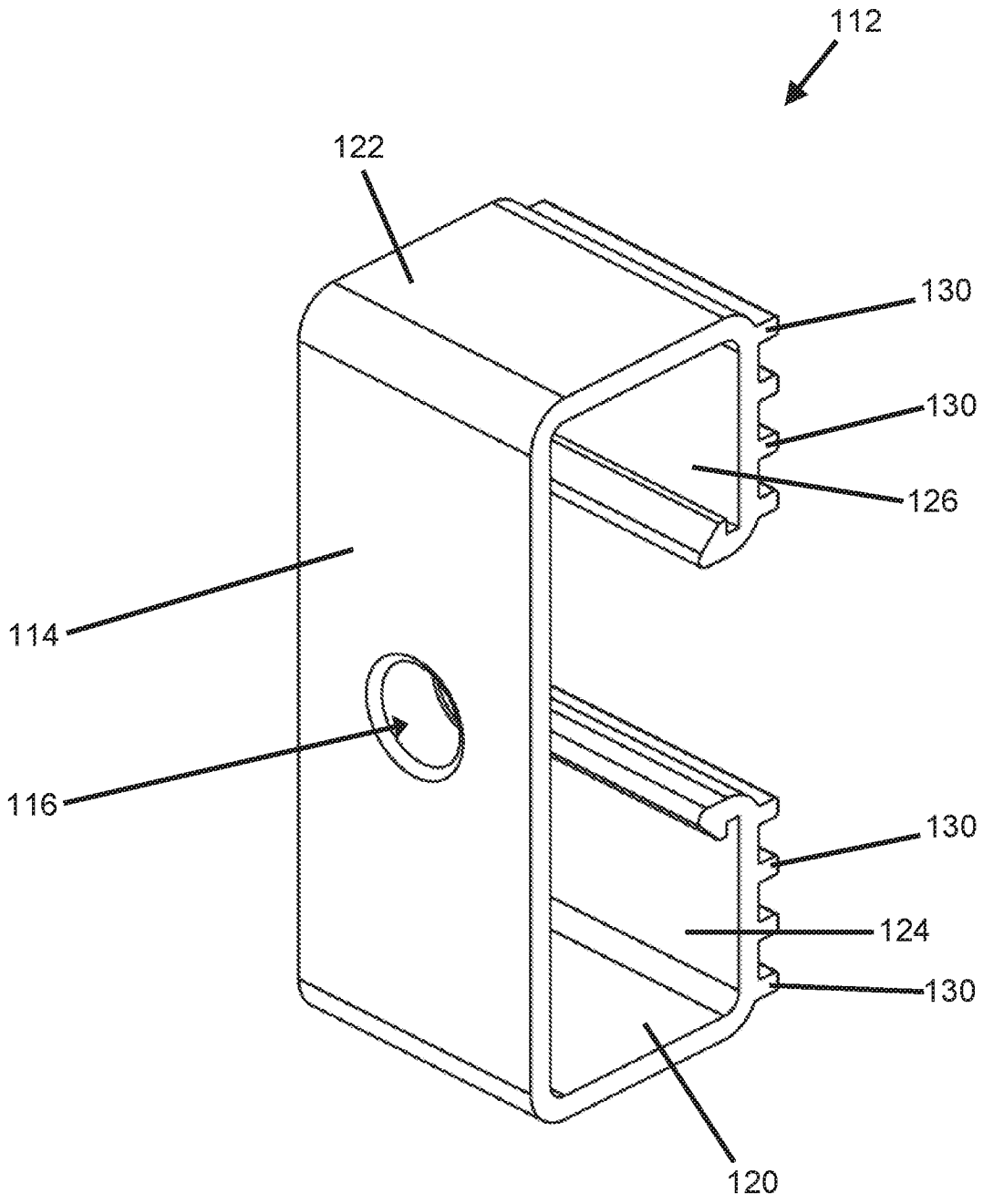
FIG. 14 is a perspective top view of the insulation of the clip assembly of FIG. 1.
Figure 15:
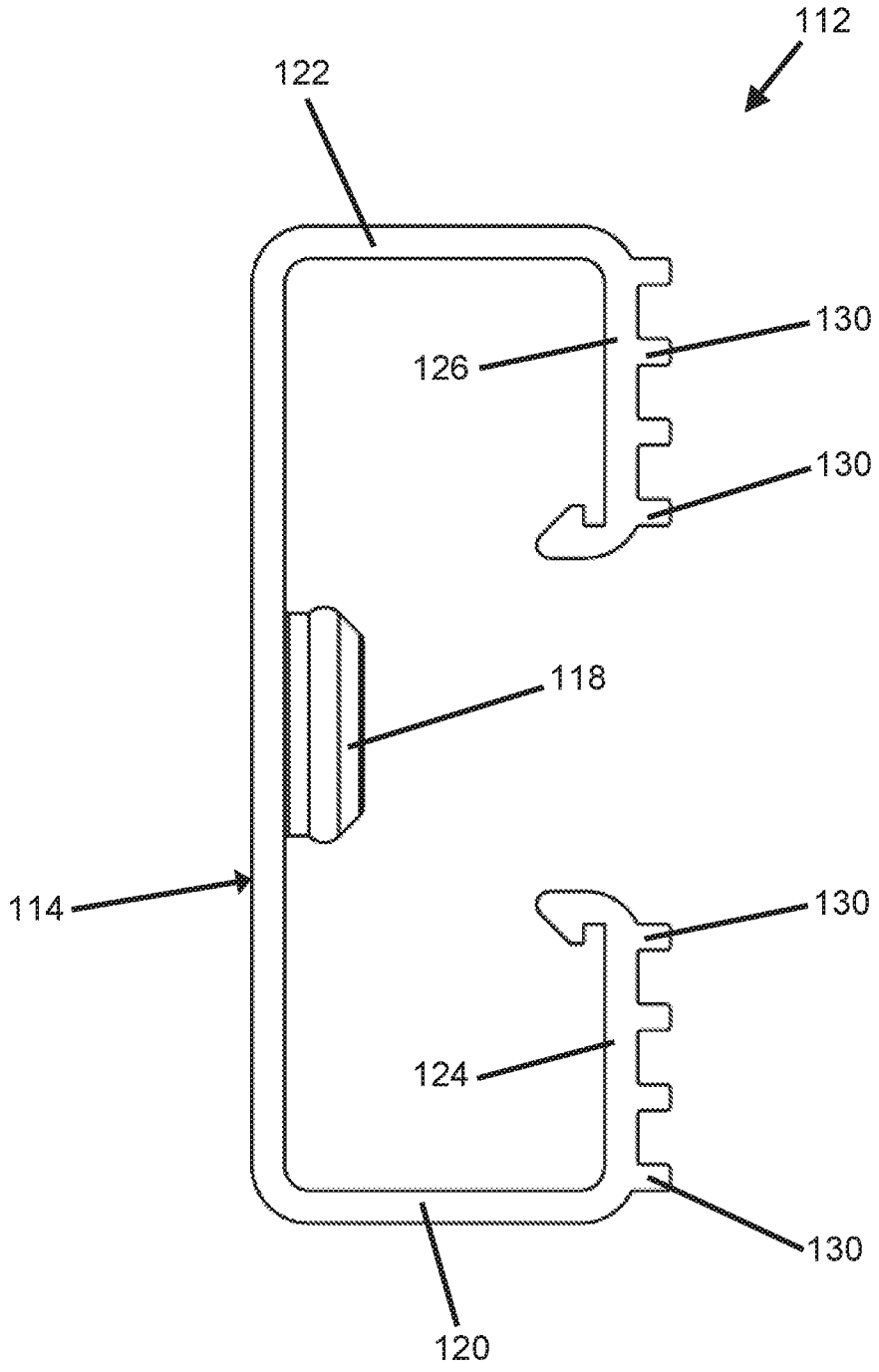
FIG. 15 is a side view of the insulation of the clip assembly of FIG. 1.

With reference to FIGS. 13 to 15, there is shown the insulation member 112 of the clip assembly 10 of FIGS. 1 to 6 in more detail.

Advantages

An advantage of the preferred embodiment of the clip includes the ability to further distance a furring channel from a support structure. Another advantage of the preferred embodiment of the clip assembly includes the ability to inhibit vibrations from traveling from a support structure to a furring channel. A further advantage of the preferred embodiment of the clip assembly includes preventing direct contact between the clip and a fastener securing the clip to a support structure.

Variations

While the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. A clip for mounting a furring channel to a support structure, the clip comprising:

a body plate attachable relative to the support structure;

at least one connection portion extending substantially transversely from the body plate, each of the at least one connection portion has two opposed connection positions adapted to connect to the furring channel, the two opposed connection positions are facing each other;

two leg portions extending substantially transversely from opposing sides of the body plate away from the at least one connection portion; and a foot portion extending substantially transversely from each leg portion and toward the opposing leg portion so as to be substantially coplanar with one another and substantially parallel to the body plate, wherein in use, when the body plate is attached relative to the support structure, each foot portion is proximal to the support structure and each of the at least one connection portion is distal to the support structure, wherein the body plate has an aperture to receive a fastener to attach the body plate relative to the support structure, and wherein the connection portion extends in a plane at substantially 90 degrees relative to the leg portions such that the connection portion and the leg portions extend at opposite directions.

2. A clip as claimed in claim 1, wherein the clip is made from pressed metal.

3. A clip as claimed in claim 1, wherein the body plate is substantially planar.

4. A clip as claimed in claim 1, wherein the at least one connection portion is two connection portions.

5. A clip as claimed in claim 4, wherein the two connection portions are opposed to one another and the two opposed connection portions extend from two opposed sides of the body plate.

6. An insulation member for a clip assembly, the insulation member comprising:

a substantially planar bed portion having two opposed ends;

two flank portions, each extending from an opposed end of the bed portion at substantially 90° to the bed portion; and a support portion extends at substantially 90° from each of the flank portions, each of the support portions including a plurality of projections extending therefrom in a direction away from the bed portion; and skirt portions at the ends of the support portions configured to snap fit to a respective foot of a clip of the clip assembly.

7. A clip assembly for mounting a furring channel to a support structure, the clip assembly comprising:

a clip comprising:

a body plate attachable relative to the support structure;

at least one connection portion extending substantially transversely from the body plate, each of the at least one connection portion has two opposed connection positions adapted to connect to the furring channel, the two opposed connection positions are facing each other;

two leg portions extending substantially transversely from opposing sides of the body plate away from the at least one connection portion;

a foot portion extending substantially transversely from each leg portion and toward an opposing leg portion so as to be substantially coplanar with one another and substantially parallel to the body plate; and an insulation member adapted to at least cover a portion of an outer surface of the body plate, a portion of an outer surface of each leg portion and a portion of an outer surface of each foot portion;

wherein in use, when the body plate is attached relative to the support structure, each foot portion is proximal to the support structure and each of the at least one connection portion is distal to the support structure, and a portion of the insulation member is located between each foot portion and the support structure, wherein the body plate has an aperture to receive a fastener to attach the body plate relative to the support structure, and wherein the connection portion extends in a plane at substantially 90 degrees relative to the leg portions such that the connection portion and the leg portions extend at opposite directions.

8. A clip assembly as claimed in claim 7, wherein the insulation member has a bed portion adapted to at least cover a portion of the outer surface of the body plate of the clip, one or more flank portions extending from the bed portion, each of the one or more flank portions adapted to at least cover a portion of the outer surface of a corresponding one of the leg portions, and a support portion extending from each of the one or more flank portions, each support portion adapted to at least cover a portion of the outer surface of a corresponding foot portion of the clip.

9. A clip assembly as claimed in claim 8, wherein the bed portion includes an aperture adapted to align with the aperture of the body plate of the clip in use.

10. A clip assembly as claimed in claim 9, wherein the insulation member includes a grommet extending from the bed portion, the grommet is adapted to be at least partially inserted into the aperture of the body plate of the clip.

11. A clip assembly as claimed in claim 8, wherein each support portion has a plurality of projections extending therefrom.

12. A clip assembly as claimed in claim 11, wherein the plurality of projections are ribs.

13. A clip assembly as claimed in claim 7, wherein the insulation member includes a rubber material to inhibit or reduce vibrations from passing therethrough.

14. A clip assembly as claimed in claim 7, wherein the clip is made from pressed metal.

* * * * *